US007255051B2

(12) United States Patent
Graham et al.

(10) Patent No.: US 7,255,051 B2
(45) Date of Patent: Aug. 14, 2007

(54) TEMPLATE TO ASSIST THE PROCESS OF CIRCULAR SEWING EMBROIDERY AND THE LIKE

(76) Inventors: Kym Joanne Graham, 13 Irwin Street, Parkwood, Queensland, 4214 (AU); Ann Margaret Duncan, 13 Irwin Street, Parkwood, Queensland, 4214 (AU)

( * ) Notice: Subject to any disclaimer, the term of this patent is extended or adjusted under 35 U.S.C. 154(b) by 14 days.

(21) Appl. No.: 10/483,407

(22) PCT Filed: Feb. 20, 2002

(86) PCT No.: PCT/AU02/00174

§ 371 (c)(1),
(2), (4) Date: Jan. 16, 2004

(87) PCT Pub. No.: WO03/004749

PCT Pub. Date: Jan. 16, 2003

(65) Prior Publication Data

US 2004/0211347 A1 Oct. 28, 2004

(30) Foreign Application Priority Data

Jul. 3, 2001 (AU) ..... PR6087
Dec. 17, 2001 (AU) ..... 2001100654

(51) Int. Cl.
*D05C 9/04* (2006.01)
*A41H 3/00* (2006.01)
*D05C 13/00* (2006.01)

(52) U.S. Cl. ..... 112/103; 33/12

(58) Field of Classification Search ..... 112/475.18, 112/439, 136, 103, 117; 33/1 G, 1 N, 1 SP, 33/1 AP, 4, 19.3, 555.1, 1 A, 1 B, 1 K, 477, 33/5, 11–17 R, 562–566; D10/64; D19/37, D19/39, 40

See application file for complete search history.

(56) References Cited

U.S. PATENT DOCUMENTS

| | | | | | |
|---|---|---|---|---|---|
| 555,287 | A | * | 2/1896 | Horrigan | 33/1 A |
| 1,301,092 | A | * | 4/1919 | Bernard | 33/477 |
| 1,611,140 | A | * | 12/1926 | Conti | 33/564 |
| 2,049,245 | A | * | 7/1936 | Breitbarth | 33/1 B |
| 2,529,413 | A | * | 11/1950 | Petersen | 434/83 |
| 2,717,566 | A | * | 9/1955 | Szczepanski et al. | 112/470.17 |
| 3,061,946 | A | * | 11/1962 | Carty | 434/87 |
| 3,795,053 | A | * | 3/1974 | Burke | 33/1 B |
| 5,511,316 | A | * | 4/1996 | Fischer et al. | 33/1 F |
| 5,722,174 | A | * | 3/1998 | Repp | 33/12 |
| 6,155,189 | A | | 12/2000 | Walner | |
| 6,860,211 | B2 | * | 3/2005 | Valeriote et al. | 112/117 |

FOREIGN PATENT DOCUMENTS

| | | |
|---|---|---|
| EP | 0 067 262 | 12/1982 |
| FR | 2396522 | 2/1979 |

* cited by examiner

*Primary Examiner*—Ismael Izaguirre
(74) *Attorney, Agent, or Firm*—Hoffman, Wasson & Gitler, P.C.

(57) ABSTRACT

A template (1) in the form of a thin disc is provided with segmental (3) and circular (4) markings, a central aperture (2), and apertures (5) which coincide with intersecting points on the markings enables centre point based positions to be plotted using the template (1) to assist in the process of circular sewing and embroidery.

10 Claims, 2 Drawing Sheets

TEMPLATE TO ASSIST THE PROCESS OF CIRCULAR SEWING EMBROIDERY AND THE LIKE

TECHNICAL FIELD

This invention relates to templates and devices for assisting the processes of circular sewing embroidery and the like.

BACKGROUND ART

The creation of regular sewing or embroidery patterns and designs is artful.

The process is assisted by the use of various types of patterns, templates, rulers and apparatus such as circular sewing attachments.

Whilst such apparatus and implements are helpful the production of regular and consistent results is not always assured and the quality of work remains dependant upon operator skill.

It is an object of the present invention to provide a template to assist the process of circular sewing and embroidery, which will enhance the quality and consistency of the craft.

Further objects and advantages of the present invention will become apparent from the ensuing description which is given by way of example.

DISCLOSURE OF INVENTION

According to one aspect of the present invention there is provided a template to assist the process of circular sewing and embroidery the template comprising a disc-like body having a central aperture, radial and circular markings on the body which enable a centrepoint positions for circular, arcuate and other patterns to be marked on a workpiece.

The radial markings can be opposed positions.

The circular markings can be regularly spaced.

The template may be approximately thirteen inches in diameter.

Major radial markings can be provided at forty-five and sixty degree spacings in four segments of the body.

Additional radial markings can be provided between major markings.

According to a further aspect of the present invention there is provided a method of forming a pattern on fabric comprising the steps of;

(a) positioning a circular sewing attachment onto the arm of a sewing machine adjacent the needle,
(b) marking a centre position on a work piece using the template device as aforesaid,
(c) marking other strategic points on the workpiece,
(d) placing the workpiece on a pin of a circular sewing attachment, adjusting the spacing of the pin relative to the needle of the sewing machine, and
(e) sewing onto the workpiece to a desired design or pattern.

BRIEF DESCRIPTION OF THE DRAWINGS

Aspects of the present invention will now be described with reference to the accompanying drawings in which.

Figure 1:
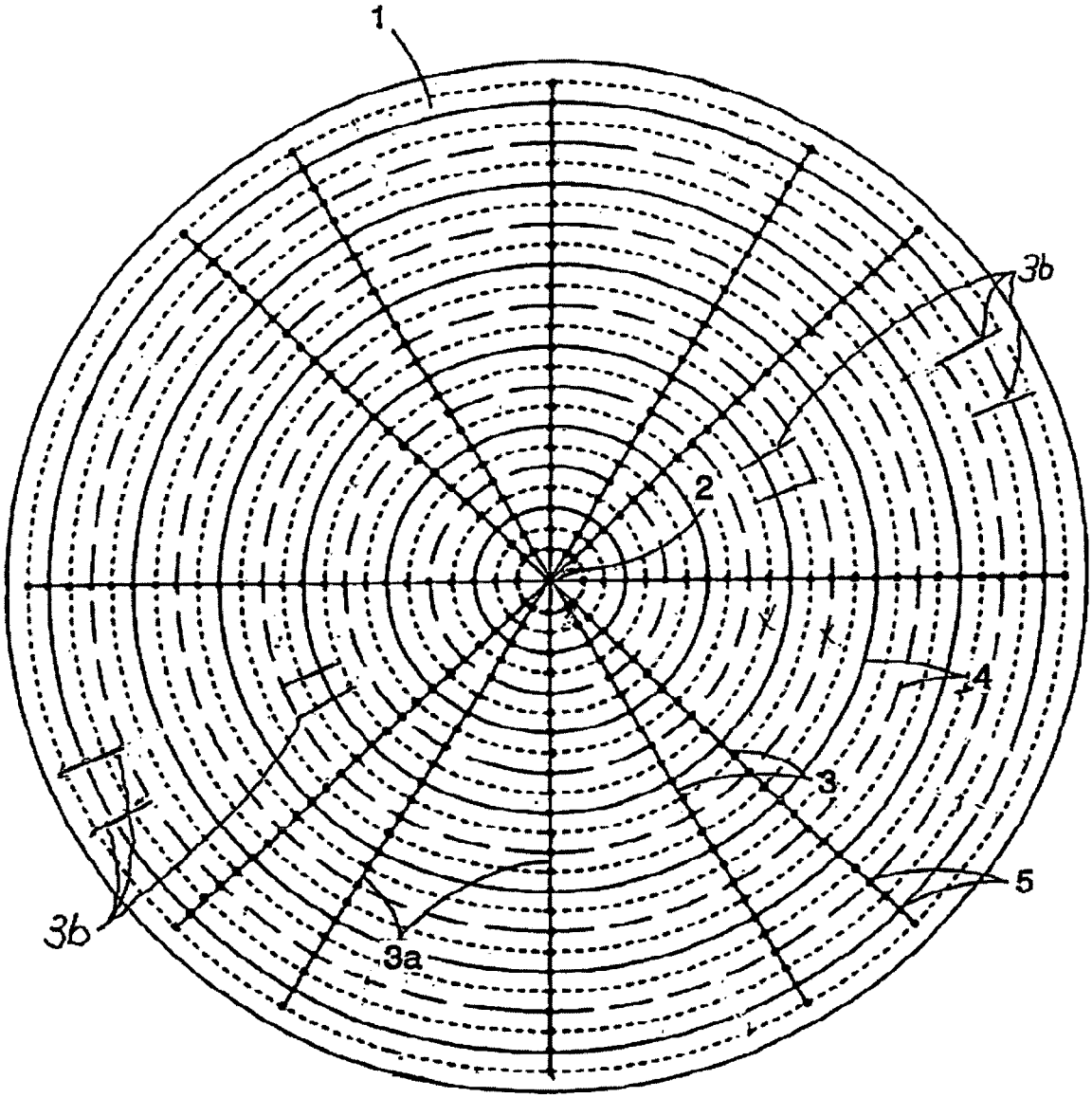
FIG. 1 is a plan view of a template device according to the present invention.

With respect firstly to FIG. 1 of the drawings a template according to the present invention may comprise a disc-like body 1 having a central aperture 2 radial markings 3, 4 on or in the body 1 and a plurality of apertures 5 in the body coinciding with intersecting points of the markings on or in the body.

The radial markings can be regularly spaced.

The circular markings are be regularly spaced.

The template may be approximately twelve and one-half inches in diameter.

Major segmental markings 3*a*, may occur at sixty and forty-five degree spacings.

Minor segmental markings 3*b* may be provided between the major segmental markings 3.

Figure 2:
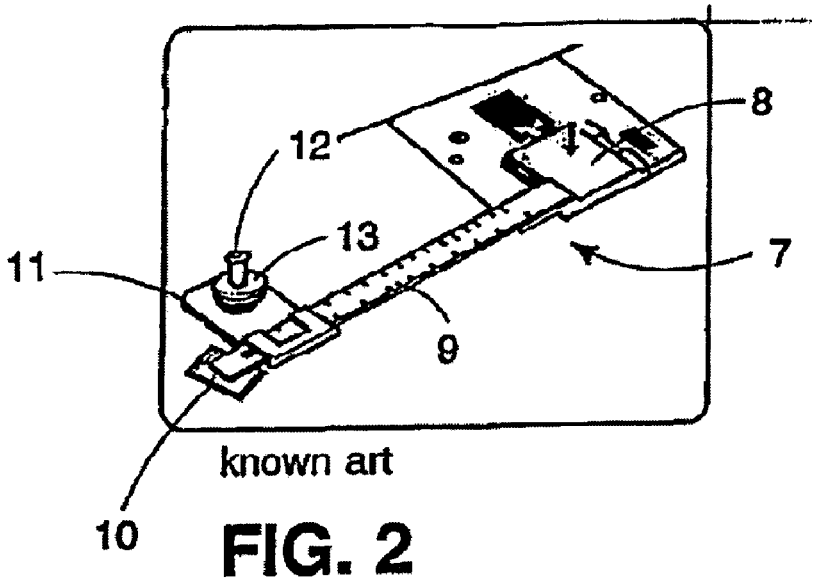
FIG. 2 is a perspective view of a typical circular sewing attachment for a sewing machine as is known in the art.

FIG. 2 of the drawings marked "known-art" illustrates a typical circular sewing attachment generally indicated by arrow 7.

The attachment 7 comprises a mounting member 8, a sliding arm 9, a lock 10 for locking the arm.

The arm 9 mounts a centre plate 11 upon which is mounted a needle 12 and centre cap 13.

After making the required markings on a workpiece using the template, including marking the centre position of a pattern via aperture 2 a workpiece can be mounted on the needle 12 and the centre cap 13 placed on the needle.

Sewing can then be commenced guiding the workpiece circularly around the centre cap.

Figure 3:
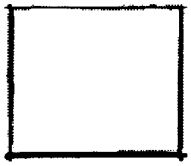
FIGS. 3 to 3*g* illustrate typical markings on a workpiece which can be made using the template device of the present invention.
Figure 3A:
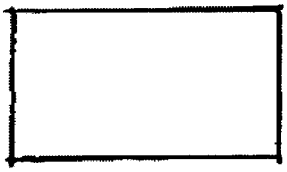
Figure 3B:
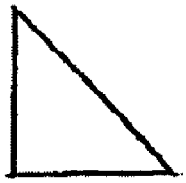
Figure 3C:
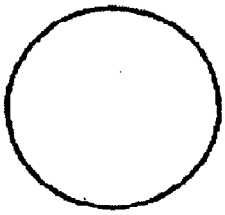
Figure 3D:
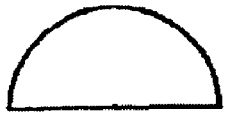
Figure 3E:
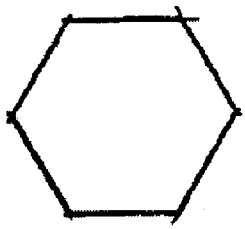
Figure 3F:
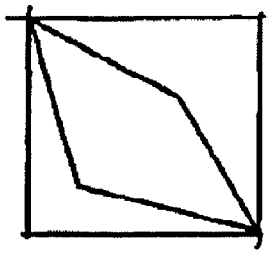
Figure 3G:
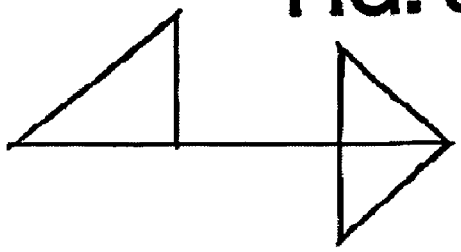

FIGS. 3 to 3*g* indicate various forms of patterns which can be marked using the template, square, rectangular, triangular, circular, semi-circular, hexagonal, combinations of these shapes.

Thus the template can be used as a universal tool for many different patterns.

A major advantage of the present invention is that use of the template will provide for accurate and symmetrical sewing and embroidery in many repeated and varied patterns.

Furthermore, the present Invention provides for;

(a) location of the central points of arcs or circles,
(b) accurate positioning of machine and hand embroidery applique and the like,
(c) It enables any shape to be marked for use in patchwork and quilting by hand, machine or the like.

Aspects of the present invention have been described by way of example only and it will be appreciated that modifications and additions thereto may be made without departing from the scope thereof, as defined in the appended claims.

The claims defining the invention are as follows:

1. A template to assist the process of circular sewing and embroidery onto a workpiece, the template comprising a disc-like body having a central aperture, a plurality of radial line markings and a plurality of circular line markings on the body, including a first category of circular line markings spaced apart in one inch increments from the central aperture and a second category of circular line markings spaced between the circular markings of the first category to mark ½ inch increments, and a plurality of apertures in the body, each aperture coinciding with an intersection point of the radial and circular line markings on the body which enable a centre point positions and guide point positions for circular, arcuate and other patterns to be marked on a workpiece.

2. A template as claimed in claim 1 wherein the radial line markings are in opposed positions.

3. A template as claimed in claim 1 wherein the circular line markings are regularly spaced.

4. A template as claimed in claim 1 wherein the template is approximately twelve and one half inches in diameter.

5. A template as claimed in claim 1 wherein major radial line markings are provided at forty-five and sixty degree spacings in four quadrants of the body.

6. A template as claimed in claim 5 wherein additional radial line markings are provided between the major radial line markings.

7. A method of sewing a pattern on fabric comprising the steps of:

(a) positioning a circular sewing attachment onto the arm of a sewing machine adjacent the needle, (b) marking a centre position on a work piece using the template device as claimed in claim 1, (c) marking other strategic points on the workpiece, (d) placing the workpiece on a pin of a circular sewing attachment, adjusting the spacing of the pin relative to the needle of the sewing machine, and (e) sewing onto the workpiece to a desired design or pattern.

8. A template as claimed in claim 1, wherein the circular markings of the first and second categories are visually different from one another.

9. A template as claimed in claim 1, further comprising a third category of circular line markings spaced between the circular line markings of the first and second categories to mark ¼ inch increments.

10. A template as claimed in claim 9, wherein the circular markings of the first, second and third categories are visually different from one another.

* * * * *